United States Patent [19]

Kälin

[11] Patent Number: 4,775,111

[45] Date of Patent: Oct. 4, 1988

[54] METHOD AND APPARATUS FOR PROCESSING FLAT PRODUCTS, ESPECIALLY PRINTED PRODUCTS

[75] Inventor: Urs Kälin, Hinwil, Switzerland

[73] Assignee: Ferag AG, Hinwil, Switzerland

[21] Appl. No.: 42,240

[22] Filed: Apr. 24, 1987

[30] Foreign Application Priority Data

Apr. 30, 1986 [CH] Switzerland ..... 1789/86

[51] Int. Cl.[4] ..... B65B 63/04; B65H 18/16; B65H 5/28

[52] U.S. Cl. ..... 242/59; 242/65; 53/118

[58] Field of Search ..... 242/59, 65, 75.1; 53/118, 119, 430

[56] References Cited

U.S. PATENT DOCUMENTS

| | | | |
|---|---|---|---|
| 3,239,161 | 3/1966 | Dutro et al. | 242/75.1 |
| 4,069,944 | 1/1978 | Achelpohl | 242/75.1 X |
| 4,434,948 | 3/1984 | Feldkamper | 242/59 |
| 4,550,883 | 11/1985 | Boss | 242/59 |
| 4,587,790 | 5/1986 | Muller | 242/59 X |

FOREIGN PATENT DOCUMENTS

| | | |
|---|---|---|
| 2949522 | 3/1971 | France . |
| 1275674 | 5/1972 | United Kingdom . |
| 2134083 | 8/1984 | United Kingdom . |

*Primary Examiner*—John M. Jillions
*Attorney, Agent, or Firm*—Werner W. Kleeman

[57] ABSTRACT

For winding-up printed products delivered in imbricated formation a winding core or mandrel or, as the case may be, the wound product package being formed thereupon is driven at its outer surface or circumference by a first drive arrangement. This first drive arrangement comprises a drive roll which engages at a winding band or strap which is wound upon the winding core or, as the case may be, the formed wound product package. By means of a second or further drive arrangement the winding band spool or reel which supplies the winding band or strap is likewise driven at its outer surface or circumference. The circumferential velocity of the winding band spool is maintained somewhat smaller than the circumferential velocity of the wound product package in order to apply tension to the winding band or strap. Both of the drive arrangements are driven by a common drive motor without the need for incorporating slip clutches, winding transmissions or gearing units and the like.

22 Claims, 6 Drawing Sheets

Fig. 2
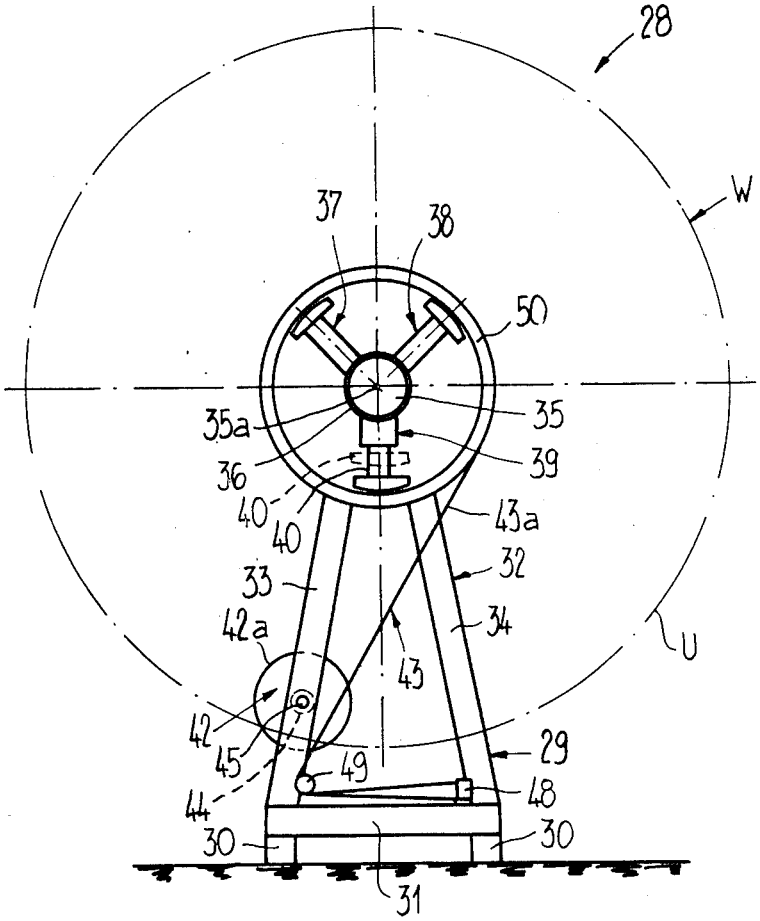
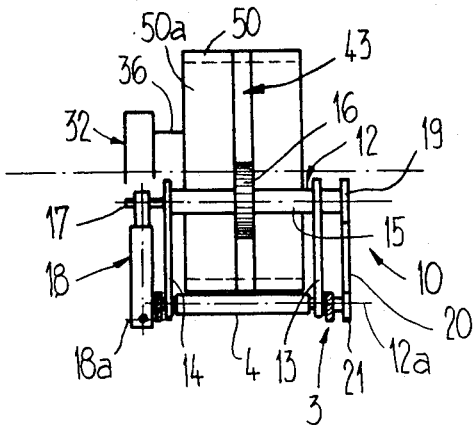
Fig.5

METHOD AND APPARATUS FOR PROCESSING FLAT PRODUCTS, ESPECIALLY PRINTED PRODUCTS

CROSS-REFERENCE TO RELATED APPLICATION

The present application is related to the commonly assigned, copending U.S. application Ser. No. 07/042,238, filed, Apr. 24, 1987, entitled "APPARATUS FOR PROCESSING PRINTED PRODUCTS, SUCH AS NEWSPAPERS, PERIODICALS AND THE LIKE, AND MOBILE STORAGE UNIT FOR USE IN SUCH PROCESSING APPARATUS". This application is also related to the commonly assigned, copending U.S. application Ser. No. 06/677,564, filed Dec. 3, 1984, granted as U.S. Pat. No. 4,676,496 on June 30, 1987, entitled "METHOD AND APPARATUS FOR SUPPLYING PRINTED PRODUCTS TO A CONTINUOUSLY OPERATING PROCESSING LINE", and which is cognate with European Published Patent Application No. 0,149,058.

BACKGROUND OF THE INVENTION

The present invention relates to a new and improved method of, and apparatus for, processing of substantially flat products, in particular although not exclusively printed products, preferably printed products arriving in an imbricated formation.

Generally speaking, the method of the present development for the processing of substantially flat products, especially printed products, preferably arriving in imbricated formation, contemplates winding-up the products together with a tensioned winding band or strap, the width of which is preferably less than the width of the products, upon a winding core or mandrel in order to form a wound product package. The winding core or mandrel or, as the case may be, the wound product package forming thereupon is placed into rotation by a drive or drive means which acts upon the outer surface or circumference thereof.

As to the apparatus aspects of the present development, such processing apparatus for processing flat products, especially printed products, preferably printed products arriving in imbricated formation, comprises a winding core which can be rotatably driven by a drive arrangement acting at the outer surface or circumference thereof. There is also provided a rotatably mounted winding band spool or reel containing a winding band or strap which can be connected with the winding core or mandrel. The width of the winding band or strap is preferably less than the width of the products. There is also provided an infeed device for the infeed of the products to the winding core or mandrel and which products are to be wound-up in conjunction with the winding band or strap upon the winding core or mandrel in order to form thereupon a wound product package.

It is known in this technology to wind-up printed products arriving in an imbricated formation upon a winding core or mandrel in conjunction with a tensioned winding band or strap. Significantly in this regard are Swiss Pat. No. 642,602 and the cognate U.S. Pat. No. 4,438,618, granted Mar. 27, 1984. To that end the winding core is driven by a drive motor through the intermediary of a winder or winding transmission or gearing unit. This drive motor also drives a feed roll over which there is guided the winding band or strap which extends from the winding band spool or reel to the winding core or mandrel. The winding band spool or reel is slightly braked by a brake arrangement or brake unit.

In basically the same fashion there is accomplished the drive of the winding core and the generation of a tensional stress or tension in the winding band or strap which is payed-off of the winding band spool or reel with the equipment disclosed in the German Patent Publication No. 3,236,866 and the corresponding British Pat. No. 2,107,681 and the cognate U.S. Pat. No. 4,587,790, granted May 13, 1986.

In both solutions the drive system is of rather complicated construction. With the last-mentioned apparatus there also prevails the circumstance that the winding core and the winding band spool or reel are not stationarily mounted but in a mobile frame or frame unit. In order to couple the winding core and the feed or conveyor roll at the wind-up station and the unwinding station with the drive devices located in these stations, the frame or frame unit must be equipped with coupling arrangements or facilities, resulting in a relatively complicated construction of the frame or frame unit.

In the European Published patent application No. 0,135,080, published Mar. 27, 1985 and the corresponding U.S. Pat. No. 4,523,751, granted June 18, 1985, there is disclosed a wind-up apparatus for printed products, wherein the winding core or mandrel and the winding band spool or reel are likewise mounted in a mobile frame or frame unit. However, the drive of the winding core or, as the case may be, the wound product package forming thereupon, is accomplished at the outer surface or circumference of the winding core or, as the case may be, the wound product package. Although as a consequence thereof there are only required the provision of coupling arrangements at the frame or frame unit for the driving of the winding band spool or reel, there is nonetheless still required a complicated construction. Additionally, with this prior art construction the danger exists that through the provision of the drive arrangement for the wound product package, which possesses a feed or conveyor band bearing at the circumference of the wound product package, the printed products are damaged. This phenomenon also is present in the case of the wind-up apparatus described in the British Pat. No. 1,275,674, published May 24, 1972.

SUMMARY OF THE INVENTION

Therefore, with the foregoing in mind it is a primary object of the present invention to provide a new and improved method of, and apparatus for, processing substantially flat products, especially printed products, which is not afflicted with the aforementioned drawbacks and shortcomings of the prior art.

Another and more specific object of the present invention is directed to a new and improved method of, and apparatus for, processing substantially flat products, especially printed products, preferably arriving in an imbricated product formation, in a highly efficient, reliable and protective manner with little likelihood of damage to the processed products.

Still a further important object of the present invention is directed to a new and improved method of, and apparatus for, processing substantially flat products, especially although not exclusively printed products, wherein there can be realized a protective processing of the products through the utilization of exceedingly simple means or structure.

A further noteworthy object of the present invention aims at the provision of a new and improved construction of apparatus for the processing of substantially flat products, especially printed products, which apparatus is relatively simple in construction and design, extremely reliable in operation, relatively economical to manufacture, not readily subject to breakdown or malfunction and requires a minimum of maintenance and servicing.

Now in order to implement these and still further objects of the invention, which will become more readily apparent as the description proceeds, the method for the processing of the substantially flat products, especially printed products, preferably printed products arriving in an imbricated formation, contemplates that the drive or drive arrangement for the winding core or mandrel or, as the case may be, the wound product package forming thereupon, only engages or contacts with the wound-up winding band or strap.

As alluded to above, the invention is no only concerned with the aforementioned method aspects, but is directed to a new and improved construction of processing apparatus for the reliable processing of such substantially flat products. According to the invention, the processing apparatus is manifested by the features that the drive or drive arrangement or drive means which acts upon the outer surface or circumference of the winding core or, as the case may be, the outer surface or circumference of the wound product package which is being formed upon the winding core, only acts or contacts the winding band or strap which is wound thereupon.

Since the drive arrangement or drive means or drive which places into rotation the winding core or mandrel or, as the case may be, the wound product package being formed thereupon, only engages with the winding band or strap which is wound on the winding core or, as the case may be, the wound product package formed or forming thereupon, the drive arrangement or drive means does not come into contact with the wound-up products. Thus, there is beneficially precluded or appreciably at least minimized any danger of damaging the products. The drive arrangement or drive means can be of very simple construction, that is to say, can possess a drive roll or roller which can be pressed into contact with the wound-up winding band or strap. The transmission of the drive forces is accomplished by such drive roll or roller to the tautly tensioned superimposed winding layers or coils of the wound winding band or strap, so that there can be accomplished a practically slip-free force transmission. Since the wound product package is constricted or crimped at the region of the winding band or strap, the drive roll engages at the wound product package in spaced relation from the rotational axis of such wound product package, and this point of engagement of the drive roll or roller is at a spacing or distance which is somewhat smaller than the radius of the wound product package in the regions located externally of the winding band or strap.

It is advantageous to also drive the winding band spool or reel at its outer surface or circumference, preferably at a circumferential velocity or speed which is somewhat smaller than the circumferential velocity or speed of the wound product package. In this way there can be produced the required tensional stress or tension in the winding band or strap without any appreciable expenditure in effort or equipment.

The drive arrangements or drive means for driving the winding core or mandrel or, as the case may be, the wound product package and the winding band spool or reel are advantageously designed, in a manner which will be discussed more fully hereinafter, so as to realize a quite simple construction of such drive arrangements.

Also there will be disclosed in greater detail hereinafter the manner and structure for the effective unwinding or unreeling of the products from the wound product package in conjunction with the winding band or strap.

The inventive design of the drive arrangements or drive means for the winding core or, as the case may be, the wound product package and the winding band spool or reel affords the possibility when utilizing mobile storage or storing units to construct such exceedingly simply, and also affords the possibility of removably or detachably mounting the winding core and winding band spool in the storage or storing unit.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 2 is a side view of the mobile storage unit used in the arrangement shown in FIG. 1;

FIG. 5 is a cross-sectional view of the arrangement depicted in FIG. 1, taken substantially along the line V—V thereof;

DETAILED DESCRIPTION OF THE PREFERRED EMBODIMENTS

Figure 1:
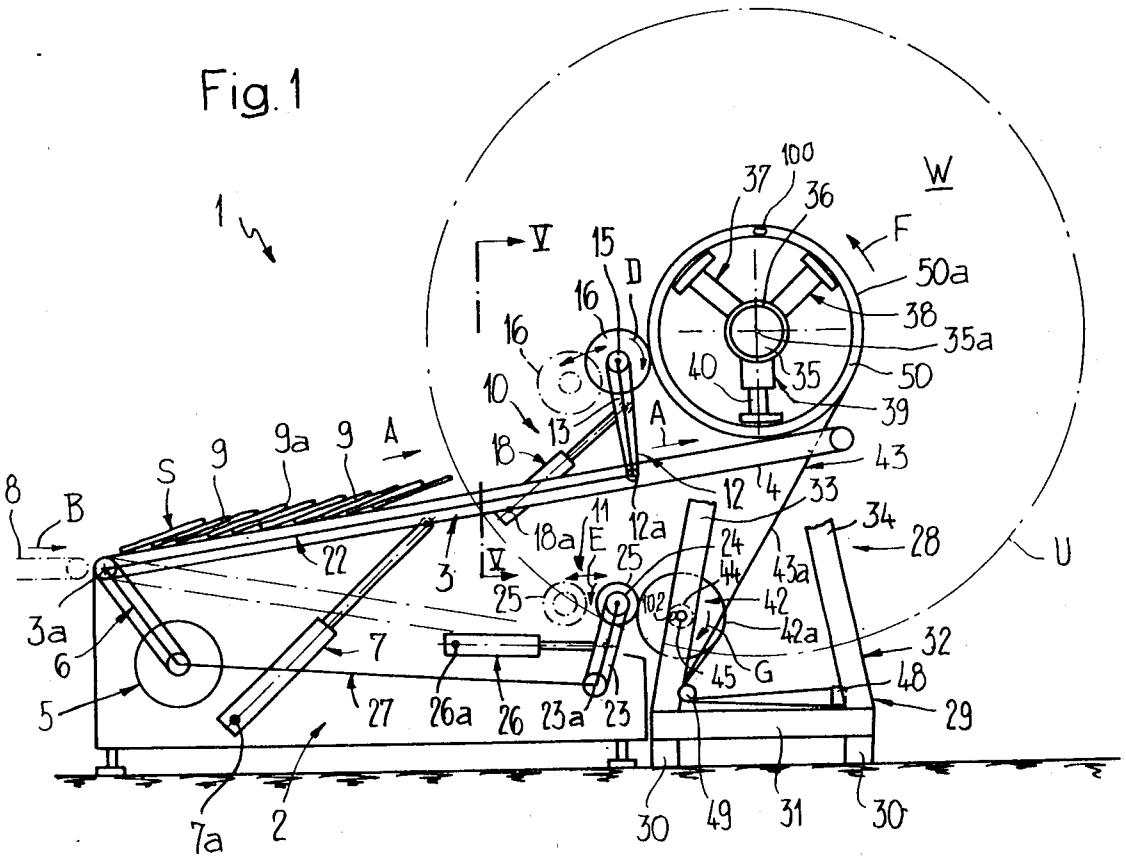
FIG. 1 schematically illustrates in side view a wind-up station equipped with a mobile storage unit and constructed according to the present invention.

Describing now the drawings, it is to be understood that to simplify the showing thereof, only enough of the structure of the processing apparatus and the related mobile storage unit has been illustrated therein as is needed to enable one skilled in the art to readily understand the underlying principles and concepts of the present development. Turning attention now specifically to FIG. 1 of the drawings, there has been depicted therein in side view and only purely in schematic illustration a wind-up station 1 which will be seen to comprise a stationary frame or frame unit 2 in which there is mounted a rocker or balance or balance arm or structure 3. This rocker or balance structure 3 is pivotable at one end thereof about the pivot axis or shaft designated by reference character 3a. In this rocker or balanee structure 3 there is arranged a band or belt conveyor 4 or equivalent structure. This band or belt conveyor 4 is driven in the direction of the arrow A by a suitable drive motor or common drive means 5 which is accommodated in the frame or frame unit 2. The appropriate drive connection between the drive motor 5 and the band or belt conveyor 4 has been generally indicated by reference character 6. Operatively engaging at one end with the rocker or balance structure 3 is a piston-and-cylinder unit 7 which is pivotably mounted in the frame or frame unit 2 at its opposite end about the pivot axis or pivot means or shaft 7a. Arranged upstream or forwardly of the rocker or balance structure 3 is a band or belt conveyor 8 which is appropriately driven in the direction of the arrow B. By means of this band or belt conveyor 8 the printed products 9, arriving in an imbricated formation S, are delivered and transferred to the band or belt conveyor 4. As particularly well recognized by further reverting to FIG. 1, within the imbricated formation S of the printed products 9 each such printed product 9 bears upon the immediately preceding or leading printed product 9, so that the leading edges 9a, which in the embodiment under discussion are constituted for instance by the fold edges or folds, are located at the top in the imbricated formation S of such printed products 9.

Also belonging to the wind-up station 1 are two drive arrangements or drive means 10 and 11. The first drive arrangement or drive means 10, the construction of which will be readily apparent from FIG. 5, comprises a first pivotable frame or frame member or first pivot mechanism 12 which is pivotably mounted in the rocker or balance structure 3 about the pivot axis or shaft 12a. The pivotable frame or frame member 12 possesses two arms or arm members 13 and 14 arranged laterally of the band or belt conveyor 4, and these arms or arm members 13 and 14 carry at their free ends a shaft or shaft member 15 (FIG. 5). A drive roll or roller 16 constructed as a friction wheel or equivalent structure is seated upon this shaft or shaft member 15. A bolt or bolt member 17, aligned with the shaft 15, protrudes laterally from the arm or arm member 14. Engaging at the bolt 17 is a piston-and-cylinder unit 18. This piston-and-cylinder unit 18 is pivotably mounted at the rocker or balance structure 3 about the pivot axis or shaft 18a. At the side located opposite the bolt 17 the shaft 15 is connected with a sprocket wheel 19 which is in drive connection by means of a chain 20 with a sprocket wheel 21 rotatably mounted at the rocker or balance structure 3. This sprocket wheel 21 is driven by the drive motor or common drive means 5 by means of any suitable and thus here only schematically depicted drive connection 22.

The other second drive arrangement or drive means 11 is contructed similar to the drive arrangement or drive means 10 and likewise possesses a second pivotable frame or frame member or second pivot mechanism 23 which is pivotably mounted in the frame 2 about the pivot axis or shaft 23a. This pivotable frame or frame member 23 possesses a shaft or shaft member 24 upon which there is seated a drive roll or roller 25 likewise constructed as a friction wheel or equivalent structure. Operatively engaging with the pivotable frame 23 is a piston-and-cylinder unit 26 which is pivotably mounted at the frame 2 about the pivot axis or shaft 26a. The shaft 24 and thus also the drive roll or roller 25 are likewise driven by the drive motor or common drive means 5. The drive connection suitable for this purpose has been schematically indicated by reference character 27.

As shown in FIG. 1 in the wind-up station 1 there is located a mobile storage or storing unit 28, the constructional details of which will be apparent from FIGS. 2 to 6 inclusive. This mobile storage unit 28 possesses a transportable frame or frame member 29 which is provided with feet or legs 30 which are mounted at the under side of a base plate or plate member 31. There is connected with this base plate 31 an upright, essentially vertical support or support member 32 which is constituted by two carriers or support elements 33 and 34 which mutually enclose an acute angle. At the upper end of this support or support member 32 there is connected therewith a shaft 35 which protrudes from the support or support member 32 essentially in horizontal direction. Upon the shaft or shaft member 35 there is rotatably mounted a sleeve or sleeve member 36. At the sleeve 36 there are secured three radially protruding or radially extending support arms or arm members 37, 38 and 39. One of these support arms 37, 38 and 39, here the support arm 39 is provided with an extendable and retractable support or support member 40.

In the carrier or support element 33 there is provided an opening 41 in which there is accommodated a winding band spool or reel 42 for a winding band or strap 43. The winding band spool or reel 42 is seated by means of its spool core 44 upon a bearing or mounting bolt or shaft 45 or equivalent structure which piercingly extends through the opening 41 and which is detachably mounted in the carrier or support element 33. At the carrier or support element 33 and at the base plate 31 there are rotatably mounted deflection rolls or rollers 46, 47, 48 and 49 over which there is guided the winding band or strap 43. This winding band or strap 43 extends from the winding band spool 42 to a hollow substantially cylindrical winding core or mandrel 50 which is constructed as a sleeve or sleeve member. This winding core 50 is retained by the support arms 37, 38 and 39. The support arms 37, 38 and 39 engage at the inner side or surface of the winding core 50.

Figure 3:
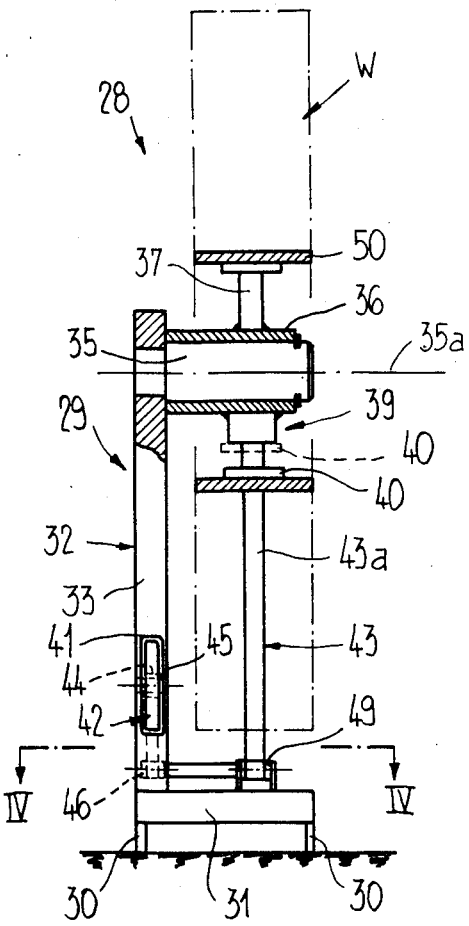
FIG. 3 illustrates in front view and partially in sectional view details of the mobile storage unit.
Figure 4:
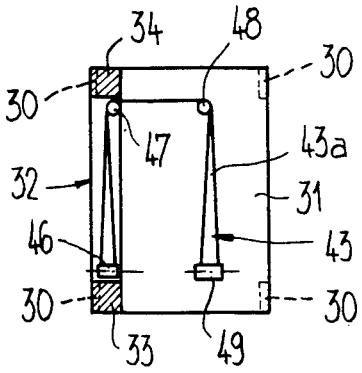
FIG. 4 is a cross-sectional view of the mobile storage unit depicted in FIG. 3, taken substantially along the line IV—IV.

As particularly evident by referring to FIG. 3, the winding band spool or reel 42 is laterally offset in relation to the winding core 50. By deflecting the winding band section or portion 43a located between the winding band spool 42 and the winding core 50 by means of the deflection rolls or rollers 46, 47, 48 and 49 this winding band section or portion 43a is brought into a position in which it is aligned approximately at the center of the winding core 50 and can travel onto the central region or center of the winding core 50, as the same has been depicted in FIGS. 3 and 5.

Before a mobile storage or storing unit 28 is mounted in the wind-up station 1 there is mounted upon the support arms 37, 38 and 39 an empty winding core or mandrel 50. For this purpose the support or support member 40 is retracted, the empty winding core 50 is placed upon both of the other support arms 37 and 38 and then the support or support member 40 is extended or thrusted out to such an extent until the winding core 50 is clamped by the support arms 37, 38 and 39 and can co-rotate together with the sleeve or sleeve member 36. Furthermore, a full winding band spool or reel 42 is mounted in the opening 41 and this full winding band spool 42 is freely rotatably seated upon the bearing or mounting bolt or bolt member or shaft 45. Thereafter the winding band or strap 43 is guided over the deflection rolls or rollers 46, 47, 48 and 49 and operatively connected with the winding core 50.

When the thus prepared mobile or transportable storage unit 28 is located in the wind-up station 1 then, by actuating the piston-and-cylinder units 18 and 26, the drive rolls or rollers 16 and 25 are pivoted or rocked until they come to bear at the outer surface or circumference 50*a* of the winding core 50 and at the outer surface or circumference 42*a* of the winding band spool 42, respectively. As a result, the drive roll or roller 16 of the drive arrangement or drive means 10 comes into contact with the outermost coil or layer of the winding band or strap 43 which has already been wound upon the winding core 50, as such has been depicted in FIG. 5. By means of the drive motor 5 there is driven, on the one hand, the band or belt conveyor 4 and, on the other hand, the drive rolls or rollers 16 and 25, and specifically in the direction D (drive roll 16) and in the direction E (drive roll 25). The rotational movement of the drive rolls or rollers 16 and 25, by virtue of the frictional contact with the winding band 43 and the winding band spool 42, respectively, produce the effect that the winding core or mandrel 50 is rotated in the direction of the arrow F and the winding band spool or reel 42 is rotated in the direction of the arrow G. The imbricated formation S of the printed products 9 which is infed by the band or belt conveyor 4 is thus wound up in conjunction with the winding band or strap 43 onto the winding core 50. This wind-up operation is accomplished basically in the manner taught in Swiss Pat. No. 642,602 and the cognate U.S. Pat. No. 4,438,618, granted Mar. 27, 1984.

So that the winding band or strap 43 travels while in a tensioned state onto the winding core 50 or, as the case may be, onto the wound product package W which is being formed thereupon, the winding band spool 42 is driven with a circumferential speed or velocity by the drive arrangement or drive means 11 which is somewhat smaller than the circumferential speed or velocity of the winding core 50 or, as the case may be, the wound product package W forming thereupon. The conveying speed of the band or belt conveyor 4 approximately corresponds to the circumferential velocity of the winding core 50 or, as the case may be, the wound product package W. This wound product package W is somewhat constricted or crimped at the region of the winding band or strap 43. Since, as already mentioned, the drive roll 16 engages in each case at the momentarily outermost coil or layer of the wound-up winding band or strap 43, the driving of the wound product package W is accomplished at a spacing or distance from the rotational axis 35*a* of the wound product package W and which spacing or distance is somewhat smaller than the radius of the wound product package externally of the region of the winding band or strap 43.

As already explained, both of the drive rolls 16 and 25 are driven by one and the same drive motor or drive means 5. This drive motor 5 also drives the band or belt conveyor 4. The drive connections 22 and 27 between the drive motor 5 and the drive rolls or rollers 16 and 25 do not contain any slip couplings, winding transmissions or gearings and the like.

Once the wound product package W has reached its final or desired package size, then the winding band or strap 43 is still wrapped a number of times about the finished or completely wound product package W. The drive rolls 16 and 25 are again lifted off the outer surface or circumference U of the wound product package W and the outer surface or circumference 42*a* of the winding band spool or reel 42 by the action of the piston-and-cylinder units 18 and 26, respectively. Then the mobile storage unit 28 is removed from the wind-up station 1 and replaced by a new mobile storage unit 28 which has been prepared in the described manner and upon whose winding core 50 there is then wound-up new printed products 9.

At the mobile storage or storing unit 28 which has been removed from the wind-up station 1 there is now retracted the support or support member 40 and thus the winding core 50 together with the wound product package W is released from the entrainment connection with the support arms 37, 38 and 39. By retracting the bearing or mounting bolt or shaft 45 the winding band spool 42 is released for its removal out of the associated opening 41. The winding core 50 together with the winding band spool or reel 42 containing the remaining length of the winding band or strap 43 are now removed from the frame or frame member 29 and brought to an intermediate storage. If the entire winding band or strap 43 has been wound-up, then the empty spool core 44, separated from the wound product package W is available for further use.

Figure 6:
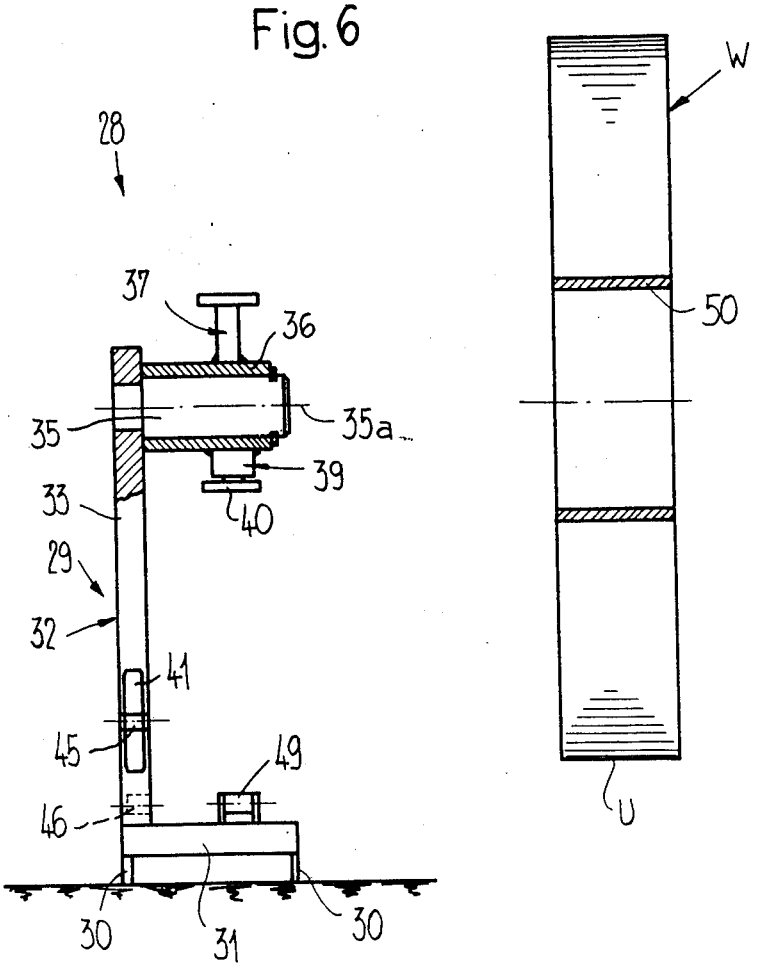
FIG. 6 is an illustration of a mobile storage unit, corresponding to the showing of FIG. 3, depicting such mobile storage unit with the wound product package removed as well as the winding band spool or reel likewise removed.

In FIG. 6 there has been depicted the mobile storage unit 28 after the removal of the wound product package W and the winding band spool 42. This mobile storage unit 28 is now ready for being newly employed or utilized, thus, for instance, for taking-up an empty winding core 50 and a full winding band spool or reel 42 in order to be again used for the formation of a new wound product package W.

Figure 7:
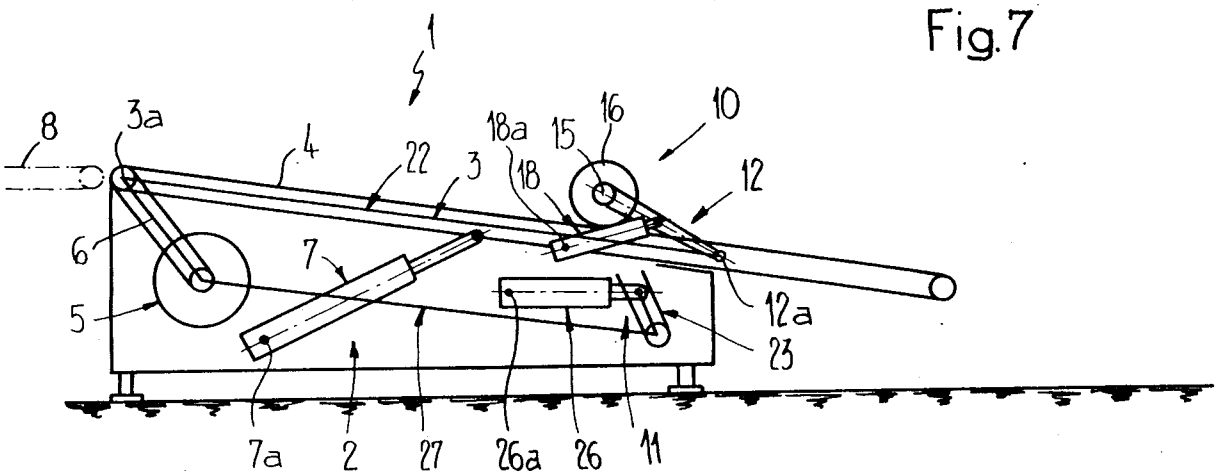
FIG. 7 illustrates a wind-up station in its non-operative state or mode and without the mobile storage unit operatively coupled thereat.

In FIG. 7 there has been depicted the wind-up station 1 in its non-operational mode where there has not been operatively coupled thereat any mobile storage unit 28. The piston-and-cylinder units 7, 18 and 26 are located in their retracted state. For the same or analogous individual components there have been conveniently utilized the same reference characters as employed in conjunction with the arrangement of FIG. 1.

Figure 8:
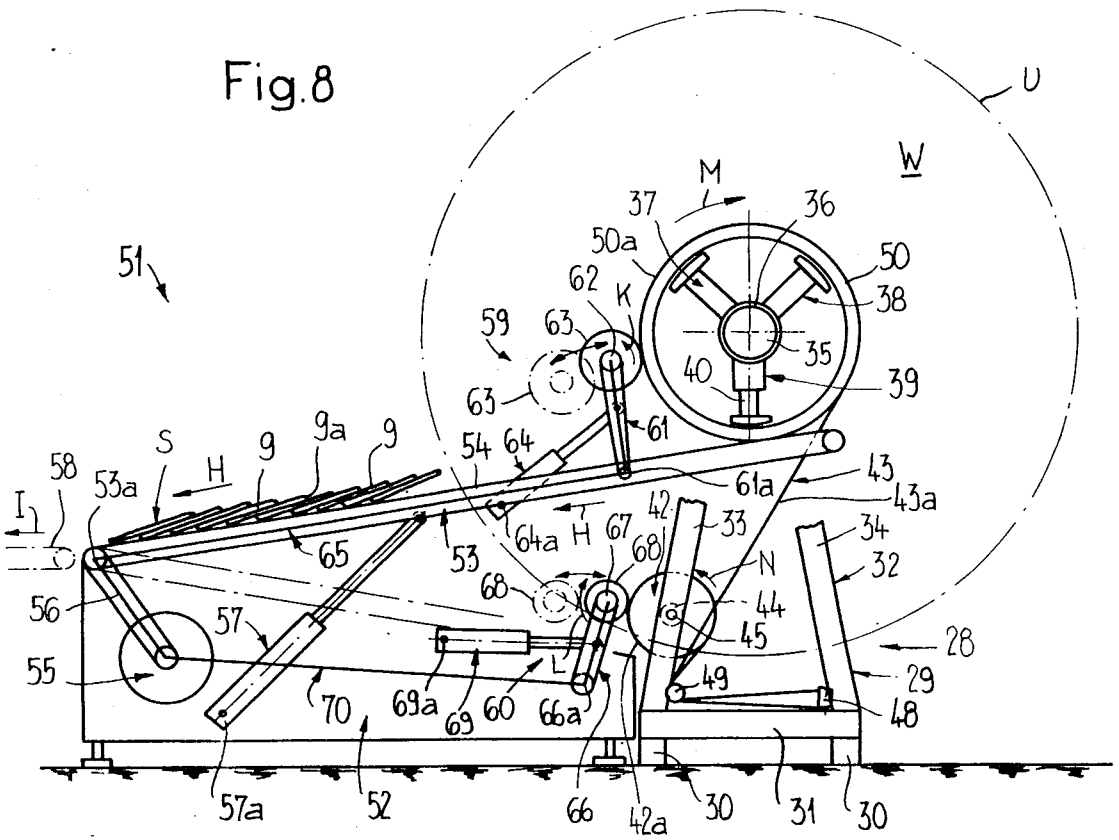
FIG. 8 is a side view of an unwinding station.

For unwinding the printed products 9 from the wound product packages W there is provided an unwinding or unreeling station 51, which has been particularly depicted in FIG. 8. This unwinding station 51 is quite similar in its construction to the wind-up station 1 and likewise possesses a stationary frame or frame member 52 in which there is pivotably mounted a rocker or balance arm or balance structure 53 or equivalent structure for pivotable movement about a pivot axis or shaft 53*a*. In this rocker or balance structure 53 there travels a band or belt conveyor 54 which is driven in the direction of the arrow H by a drive motor 55 accommodated in the frame or frame member 52. The corresponding drive connection has been designated by reference character 56. At the rocker or balance structure 53 there engages a piston-and-cylinder unit 57 which is pivotably mounted at the frame or frame member 52 about the pivot axis or shaft 57*a*. Arranged after or downstream of the rocker or balance structure 53 is a band or belt conveyor 58, the conveying direction of which has been designated by reference character I.

The unwinding station 51 possesses two drive arrangements or drive means 59 and 60 which are of similar construction as the drive arrangements or drive means 10 and 11 of the wind-up station 1. Consequently, the drive arrangement or drive means 59 possesses a pivotable frame or frame member 61 which is pivotably mounted in the rocker or balance structure 53 about the pivot axis or shaft 61*a*. This pivotable frame or frame member 61 possesses a shaft 62 upon which there is seated a drive roll or roller 63 constructed as a friction wheel or equivalent structure. At the frame or frame member 61 there engages a piston-and-cylinder unit 64 which is pivotably secured at the rocker or balance structure 53 for pivotal movement about the pivot axis or shaft 64*a*. The drive roll 63 is driven by the drive motor 55 through the here only schematically depicted but conventional drive connection 65.

The other drive arrangement or drive means 60 likewise possesses a pivotable frame or frame member 66 which is pivotably mounted at the frame 52 for pivotal movement about the pivot axis or shaft 66*a*. The pivotable frame possesses a shaft 67 upon which there is seated a drive roll or roller 68 constructed as a friction wheel or equivalent structure. At the pivotable frame 66 there engages a piston-and-cylinder unit 69 which is pivotably mounted at the frame 52 so as to be pivotable about the pivot axis or shaft 69*a*. The drive roll 68 is driven by the drive motor 55 by the drive connection generally indicated by reference character 70.

The drive rolls or rollers 63 and 68, in contrast to the drive rolls or rollers 16 and 25 of the wind-up station 1, are driven in the opposite rotational direction or sense, namely in the direction of the arrow K (drive roll 63) and the arrow L (drive roll 68). These drive rolls 63 and 68 likewise engage at the outer surface or circumference U of the wound product package W and at the outer surface or circumference 42*a* of the winding band spool 42, respectively. This means that the wound product package W is rotated in the direction of the arrow M and the winding band spool 42 is rotated in the direction of the arrow N. Just as was the case for the wind-up station 1 previously described, the drive roll or roller 63 engages in each case with the momentary outermost layer or coil of the winding band or strap 43 which has been wound upon the wound product package W. The drive of the wound product package W and the winding band spool or reel 42 is accomplished essentially in the same manner as described previously with respect to the wind-up or winding-up operation. Nonetheless the wound product package W is driven at a circumferential speed or velocity which is somewhat less than the circumferential speed or velocity of the winding band spool 42 in order to maintain the winding band or strap 43 tensioned during the unwinding operation.

For unwinding the printed products 9 from a wound product package W the latter is mounted in an empty mobile storage or storing unit 28. In so doing the winding core 50 is placed upon the support arms or arm members 37 and 38, whereupon the support or support member 40 is extended or thrusted out and the winding core 50 is clamped. Then the free winding band end is connected with the spool core 44 which is mounted upon the bearing or mounting bolt or shaft 45 or equivalent structure. As a result the mobile storage unit 28 is ready for accomplishing the unwinding or unreeling operation.

The thus prepared mobile or transportable storage unit 28 is brought to the unwinding station 51, whereupon the drive rolls 63 and 68 are brought into contact with the wound product package W an the winding band spool 42, respectively. By driving the winding band spool 42 the winding band 43 is wound-off of the wound product package W, and at the same time the imbricated formation S of printed products 9 is also unwound and outfed by means of the band or belt conveyor 54 and then transferred to the band or belt conveyor 58. In the unwound imbricated formation S each printed product 9 no longer bears upon the preceding printed product, rather upon the trailing printed product. This means that the edges 9*a*, which constituted the leading product edges prior to the winding-up operation, now constitute the trailing edges.

As soon as all of the printed products 9 have been unwound, then the now empty mobile storage unit 28 is removed from the unwinding station 51 and replaced with a loaded mobile storage unit 28 which is then emptied in the aforedescribed manner.

The emptied mobile storage unit 28 can now be directly brought to a wind-up station 1 since it is basically ready for winding-up printed products. However, it is also possible to remove the empty winding core 50 and the full winding band spool 42 and to load the mobile storage unit 28 once again with a finalized or full wound product package W and an empty spool core 44 or, as the case may be, the winding band spool 42 belonging to such wound product package W.

Apart from the foregoing there also of course is available the possibility, after completion of a wound product package W, not to remove such from the mobile storage unit 28, rather to transport this mobile storage unit 28 together with the wound product package W and the winding band spool 42 directly to an unwinding station 51 or to an intermediate storage or storage area. In such case there must be prevented that the winding band 43 can loosen or unravel, since otherwise there exists the danger of disintegration or falling apart of the wound product package W. Therefore there must be provided at the mobile storage unit 28 means for blocking the winding band spool 42 and the wound product package W, so that such cannot rotate in the sense of unwinding the wound product package W and the thereon wound winding band 43. Such blocking means 100 and 102 (see FIG. 1) can be constituted by, for instance, insertable bolts or pin members or equivalent structure which engage at the winding core 50 and at the spool core 44, respectively, brake devices or the like.

As particularly evident by referring to FIG. 6, the mobile storage units 28 are quite simple in construction, since only mounting or support means 35 to 40 and 45 need be provided for the removable mounting of the winding cores 50 and the winding spools 42 as well as deflection rolls or rollers 46 to 49. Contributing to the simple constructional design is furthermore the fact that the winding band spool 42 is mounted in the carrier or support element 33. Thus there can be realized a saving in a separate support for mounting the winding band spool 42.

Since the winding core 50 or, as the case may be, the wound product package W and the winding band spool 42 are driven in the described manner at their outer surface or circumference 5*a* and U and 42*a*, respectively, there are not required at the mobile storage unit 28 any coupling devices for coupling the stationary drives.

The mobile storage units 28 are continuously capable of being placed into operation or used, since the wound product packages W and the winding band spools 42 can be removed and the mobile storage units 28 thus need not of necessity remain blocked in an intermediate storage or storage area.

By virtue of the fact that the drive of the winding core 50 or, as the case may be, the wound product package W and the winding spools 42 is accomplished by drive rolls or rollers engaging at the corresponding outer surface or circumference thereof, the drive arrangements or drive means 10, 11 and 59, 60 can be of very simple design. Slip couplings or clutches, winder or winding transmissions or gearing units and the like are not needed.

Since the drive rolls or rollers 16 and 63 of the drive arrangements 10 and 59, respectively, engage at the winding band or strap 43 and not at the printed products 9, there is no danger of damage to such printed products 9.

It should be understood that the previously discussed manner and technique of driving the winding core or mandrel or, as the case may be, the wound product package formed thereupon and the winding band spool or reel also then affords advantages when the winding core and the winding band spool are not detachably or removably mounted in the mobile storage or storing unit or, in fact, not mounted at all in any such storage or storing unit, rather are supported by means of mounting or support arrangements which are fixedly arranged at the wind-up and unwinding stations, as such has been disclosed, for instance, in the previously mentioned Swiss Pat. No. 642,602 and the cognate U.S. Pat. No. 4,438,681.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method for processing substantially flat products, especially printed products, preferably arriving in imbricated formation, comprising the steps of:

winding-up the products in conjunction with a tensioned winding band upon a winding core in order to form a wound product package;

driving the winding core and the wound product package which is being formed thereupon by means of a first drive acting upon the winding core and upon the wound product package formed thereupon;

operating said first drive so as to only engage at the wound-up winding band; and using as the winding band a winding band having a width which is less than the width of the products.

2. The method as defined in claim 1, further including the steps of:

unwinding the products together with the winding band from the wound product package;

during such unwinding operation winding-up the winding band upon a rotatably driven winding spool; and rotationally driving the winding spool by a second drive engaging at the circumference of said winding spool.

3. The method as defined in claim 1, further including the steps of:

paying-off the winding band from a winding band spool.

4. The method as defined in claim 3, wherein:

said winding band spool is driven at its circumference at a circumferential velocity which is smaller than the circumferential velocity of the wound product package.

5. The method as defined in claim 3, further including the steps of:

unwinding the products together with the winding band from the wound product package;

winding-up the winding band onto winding band spool which is rotatably driven; and rotatably driving the winding band spool by means of a second drive which engages at the circumference of the winding band spool.

6. The method as defined in claim 2, further including the step of:

during said step of unwinding said products, driving the wound product package at its circumference at a predetermined circumferential velocity.

7. The method as defined in claim 6, wherein: said predetermined circumferential velocity of the wound product package is smaller than the circumferential velocity of the winding band spool.

8. The method as defined in claim 6, further including the step of:

driving the wound product package by a drive engaging at the wound-up winding band.

9. An apparatus for processing substantially flat products, especially printed products, preferably arriving in an imbricated formation, comprising:

a winding core upon which there are wound the products to form a wound product package;

a first drive arrangement cooperating with said winding core and the wound product package which is being formed thereupon for rotatably driving the winding core and the wound product package formed thereon at the circumference of the winding core and the wound product package which is being formed thereon;

a rotatably mounted winding band spool for a supply of a winding band connectable with the winding core;

infeed means for infeeding the products together with the winding band to the winding core which are to be wound thereupon into the wound product package;

said first drive arrangement only engaging at the wound-up winding band; and said winding band spool carrying a supply of a winding band having a width which is less than the width of the products.

10. The apparatus as defined in claim 9, further including:

a second drive arrangement engaging at the circumference of the winding band spool.

11. The apparatus as defined in claim 10, wherein:

said second drive arrangement drives the winding band spool at a circumferential velocity which is less than the circumferential velocity of the wound product package.

12. The apparatus as defined in claim 10, wherein:

said first drive arrangement comprises a drive roll which can be placed into contact with the winding core and the wound product package which is being formed thereupon; and said second drive arrangement comprises a drive roll which can be placed into contact with the circumference of the winding band spool.

13. The apparatus as defined in claim 12, further including:

common drive means for driving both of the drive rolls.

14. The apparatus as defined in claim 12, further including:

a first pivot mechanism cooperating with said drive roll which can be placed into contact with the winding core and the wound product package which is being formed thereupon;

a second pivot mechanism provided for said drive roll which can be placed into contact with the circumference of the winding band spool;

each of said drive rolls being selectively pivotable from an inoperative position into a drive position;

said drive roll which can be placed into contact with the winding core and the wound product package which is being formed thereupon, when in its drive position, bearing upon the winding band located at the winding core and the wound product package which is being formed thereupon; and said drive roll which can be placed into contact with the circumference of said winding band spool, when in said drive position, engaging with the circumference of the winding band spool.

15. The apparatus as defined in claim 9, wherein: said processing apparatus serves for the unwinding of the products and the winding band from the wound product package; and a further drive arrangement engaging at the circumference of the winding band spool and serving for rotatably driving the winding band spool for the purpose of winding-up the winding band.

16. The apparatus as defined in claim 15, further including:

an additional drive arrangement engaging at the winding band wound upon the wound product package during such winding operation.

17. The apparatus as defined in claim 16, wherein: said additional drive arrangement drives the wound product package at a circumferential velocity which is less than the circumferential velocity of the winding band spool.

18. The apparatus as defined in claim 16, wherein:

said further drive arrangement comprises a drive roll which can be placed into contact with the circumference of the winding band spool; and said additional drive arrangement comprises a drive roll which can be placed into contact with the winding band which has been wound-up upon the wound product package.

19. The apparatus as defined in claim 18, further including:

common drive means for driving both of said drive rolls of the further drive arrangement and said additional drive arrangement.

20. The apparatus as defined in claim 18, further including:

a first pivot mechanism provided for the drive roll of the further drive arrangement;

a second pivot mechanism provided for the drive roll of the additional drive arrangement;

each of said drive rolls being selectively pivotable from an inoperative position into a drive position;

said drive roll of the further drive arrangement, when in said drive position, engaging at the circumference of the winding band spool; and said drive roll of said additional drive arrangement, when in said drive position, engaging at the winding band which is wound-up upon the wound product package.

21. The apparatus as defined in claim 10, wherein:

said winding core comprises a hollow substantially cylindrical wining core;

a mobile storage unit;

means for freely rotatably mounting said hollow substantially cylindrical winding core in said mobile storage unit;

means for freely rotatably mounting said winding band spool in said mobile storage unit; and said mobile storage unit being selectively movable into operative engagement with any one of either a wind-up station in which there are located the first and second drive arrangements, or an unwinding station in which there are located further and additional drive arrangements.

22. The apparatus as defined in claim 21, further including:

respective means for detachably mounting each of said hollow substantially cylindrical winding core and said winding band spool at the mobile storage unit.

* * * * *

UNITED STATES PATENT AND TRADEMARK OFFICE

CERTIFICATE OF CORRECTION

PATENT NO. : 4,775,111

DATED : October 4, 1988

INVENTOR(S) : URS KäLIN

It is certified that error appears in the above-identified patent and that said Letters Patent is hereby corrected as shown below:

Column 3, line 22, please delete "no" and insert --not--

Column 13, line 42, please delete "such winding" and insert --said unwinding--

Signed and Sealed this

Twentieth Day of June, 1989

*Attest:*

*Attesting Officer*

DONALD J. QUIGG

*Commissioner of Patents and Trademarks*